US005299999A

United States Patent [19]

Brine

[11] Patent Number: 5,299,999

[45] Date of Patent: Apr. 5, 1994

[54] WEIGHT PACK

[76] Inventor: William G. Brine, 2133 A Alfred Ave., St. Louis, Mo. 63110

[21] Appl. No.: 665,672

[22] Filed: Mar. 7, 1991

[51] Int. Cl.[5] ..... A63B 21/18; A45F 3/04

[52] U.S. Cl. ..... 482/105; 224/210; 482/93

[58] Field of Search ..... 482/105, 93; 224/210, 224/211, 201, 265, 266, 271

[56] References Cited

U.S. PATENT DOCUMENTS

| | | | |
|---|---|---|---|
| 2,611,519 | 9/1952 | Utterström | 224/211 X |
| 3,127,077 | 3/1964 | Faro | 224/210 |
| 3,370,850 | 2/1968 | Moore | 272/84 |
| 3,751,031 | 8/1973 | Yamauchi | 272/57 R |
| 4,109,908 | 8/1978 | Pugh et al. | 272/119 |
| 4,332,379 | 6/1982 | Bannister | 272/119 |
| 4,391,397 | 7/1983 | Taylor, Jr. | 272/119 X |
| 4,538,750 | 9/1985 | Hanna | 224/210 X |
| 4,558,808 | 12/1985 | Fullmer | 224/210 X |
| 4,836,938 | 6/1989 | Kobasic | 224/210 X |
| 5,031,811 | 7/1991 | Charest | 224/201 X |

FOREIGN PATENT DOCUMENTS

| | | | |
|---|---|---|---|
| 1354399 | 1/1964 | France | 224/210 |
| 2492264 | 10/1980 | France . | |
| 72710 | 10/1947 | Norway | 224/251 |

*Primary Examiner*—Gene Mancene
*Assistant Examiner*—L. Thomas
*Attorney, Agent, or Firm*—Heller & Kepler

[57] ABSTRACT

A weight pack for exercising which has a rigid insert constituting the main support member for the backpack. The insert having a body section which corresponds to the back of the wearer and a weight shelf extending from the body section to hold removable weights. The removable weight used either singularly or in multiples to achieve the weight desired by the wearer and stabilized within the bag. The insert and weights being enclosed within a bag or pack to provide an aesthetic appearance and comfort for the wearer.

16 Claims, 5 Drawing Sheets

WEIGHT PACK

The present invention relates in general to a weight pack for use in exercising and pertains, more particularly, to a weight pack having removable weights which can be worn while performing other activities. The weight pack of this invention is an improvement over the conventional weight systems used during exercise.

BACKGROUND OF THE INVENTION

There are various forms of weights and packs which relate to exercise. With the conventional weight pack it is generally designed for use in a particular type of exercise or exercise program. There are not many types of weights which can be used when performing other activities or which are adaptable to routine activities.

Generally, there are barbells for common exercise, physical training and body conditioning. There are also several types and designs of hand weights and ankle weights. But these types of weights cannot be used while performing other activities and are usually specifically designed for a particular exercise routine.

Another conventional approach to solving the drawbacks associated with these devices is to provide a collapsible exercise backpack. The collapsible device may include straps for attaching the pack to the person, the pack having an opening for receiving a flexible weight member, and a weight member consisting of a flexible and disposable weight material. When the weight material is removed, the backpack is collapsible to a minimum size and weight.

Accordingly, it is an object of the present invention to provide a device having an exercise capability that is simple, usable by practically anyone who qualifies physically, exerts low stress on the back, knees and feet and is easily adaptable for use during routine activities.

Another object of the present invention is to provide an improved weight pack in the form of a backpack which is substantially rigid and will not easily or readily deform or become unbalanced, for example, by allowing a weight shift while wearing the weight pack and performing other activities.

A further object of the present invention is to provide a weight pack in a preferred form of a backpack for exercising which can accommodate a varying amounts of weights. The weights can be selected and either added or removed as desired by the user.

Still another object of the present invention is to provide a weight pack with the outward appearance of a conventional backpack in which is the selected weights are mounted for ease of selection and change by the wearer.

Still a further object of the present invention is to provide a weight pack having many of the functional characteristics of a conventional backpack which can also be used for exercising. The weight pack of the present invention is easily and conveniently put on and worn by the wearer with only the most minimum of preparation.

Another object of the present invention is to provide a weight pack that is constructed to form an economically produced backpack for exercising which can be used as a conventional backpack when not used with the weights.

SUMMARY OF THE INVENTION

To accomplish the foregoing and other objects of this invention there is provided a weight pack for carrying one or more weights in a backpack construction. The backpack is constructed to receive removable weights. The weights can be added or removed to obtain the exercise weight desired by the wearer.

The weight pack comprises one embodiment in which a plastic molded insert of the weight pack is molded from a plastic type material. The pack typically comes in a standard size having a means to adjust for the various sizes of the wearer. Further, the weight pack can come in various sizes to accommodate the size of the wearer if the standard size is not adequate.

The weight pack consists of a plastic molded insert which is the main support frame of the pack. The molded plastic insert has a body which fits against the back of the wearer and has a weight shelf extending at approximately 90° from the bottom of the body. Proximate the bottom of the plastic molded insert is a curvature that generally conforms to the small of the back.

In one embodiment triangular pieces are included which fit generally on top of the weight shelf and extend back into the body of the plastic molded insert to provide strength and stability for the weight shelf. For added, strength, the weight shelf and back can be molded together as a single piece. The purpose of the weight shelf is to provide support for the removable weights.

Weights are held in place by weight rods which are screwed into openings within the weight shelf. Typically, there will be two weight rods to securely hold the weights in place. The weights are generally rectangular, and may come in various weights so that they can be added or removed to achieve the weight desired by the wearer. The weights are typically rectangular so they correspond to the inside shape or contour of the weight pack and securely fit on the weight shelf.

The weights are also designed and shaped for easy grasping, placement and removal. The weights also have holes within the body of the weights for inserting and sliding the weights over the weight rods.

In the disclosed embodiment described herein, the weight pack is placed over the shoulders of the wearer by a pair of J-hooks. These J-hooks are attached to the body of the plastic molded inserts by J-hook fingers. These fingers allow vertical adjustment of the J-hooks so that the height can be adjusted based upon the height of the wearer.

The weight pack also includes a cover or bag which fits over the plastic molded insert and weights. This provides additional support to securely hold the weights in place and to provide an aesthetic appearance of the weight pack. The bag is typically made of a heavy, reinforced, waterproofed canvas. However, it can be made of any other similar type material.

In one preferred embodiment the cover is sewn together in a bag-like construction so that the entire weight pack will fit within the bag. The top of the bag provides a flap which can be opened and closed for easily removing the weights. The J-hooks extend from the top of the bag in such a manner that the inverted J-hooks can be placed over the shoulders of the wearer. A preferred embodiment of the bag also includes a belt near the bottom and by the curvature of the plastic molded insert to securely hold the weight pack against the wearer.

To create a comfortable fit, the side of the bag that will be against the body receives a cushioning material. Some cushioning material is also used for the inside of the J-hooks for cushioning these hooks against the wearer's shoulders for additional comfort.

In operation, a wearer typically inserts a desired amount of weights, by sliding the weight over weight rods which hold the weights in place, and closes the bag. The wearer places the weight pack on his back with the J-hooks resting on his shoulders and tightens the belt around his waist. The weight pack is on the back of the wearer leaving the arms and hands free. The described fit of the weight pack on the wearer allows the wearer to participate in other activities.

These and other objects and features of the present invention will be better understood and appreciated from the following detailed description and the various embodiments thereof, selected for purposes of illustration and shown in the accompanying drawings.

DETAILED DESCRIPTION

Figure 1:
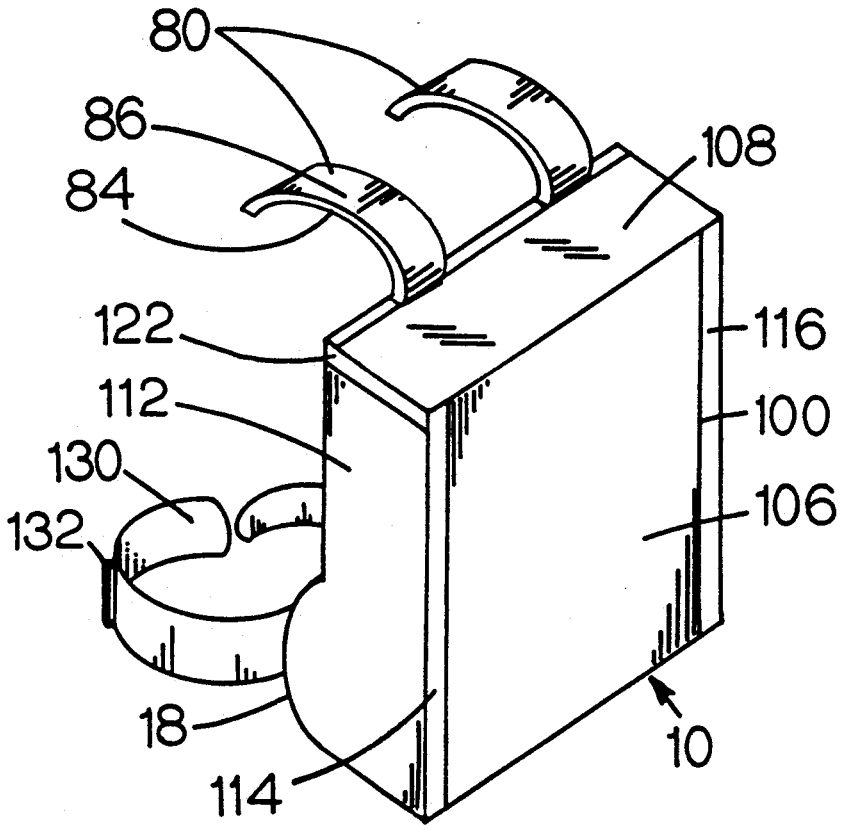
FIG. 1 is an isometric view showing one preferred embodiment of a weight pack constructed in accordance with the present invention.
Figure 2:
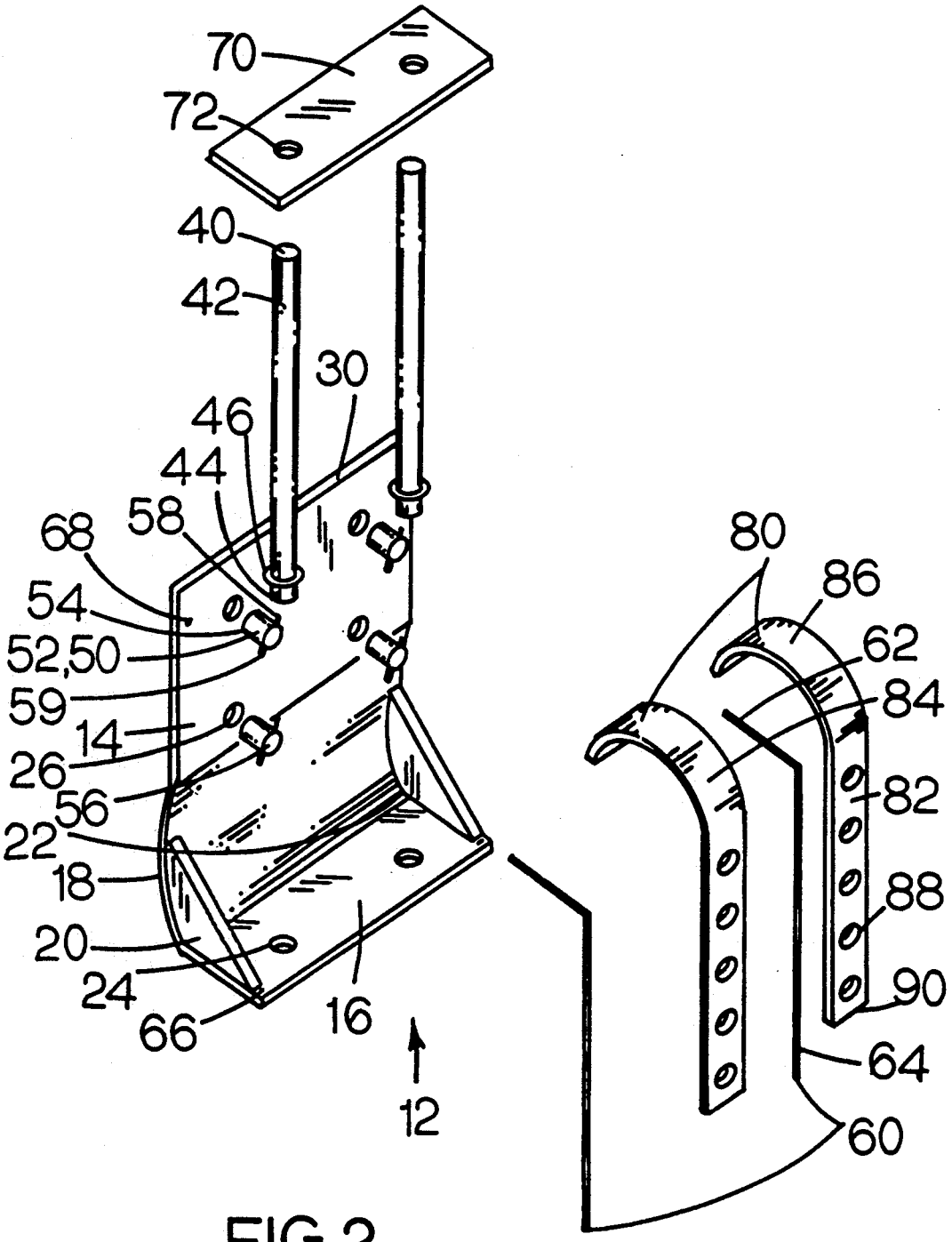
FIG. 2 is an exploded view of components used to construct the backpack embodiment of the weight pack of the present invention.

Referring now to the drawings there is shown a preferred embodiment for the weight pack of this invention. The weight pack is described in connection with a backpack application to carry the weights while participating in activities such as walking, biking, or hiking. The weight pack of the present invention is particularly adapted for providing relatively easy access to a weight receiving portion of the pack and is characterized by an improved package and storage feature of a disassembled backpack.

The drawings show the weight pack 10 in conjunction with a plastic molded insert 12 providing a supporting frame for the weight pack 10 and associated weight rods 40, J-hook fingers 50, support rods 60, weights 70, J-hooks 80, and bag or cover 100.

The plastic molded insert 12 molded as a single unit in one preferred embodiment. The molded unit provides additional strength but can be substituted with another preferred embodiment individual pieces, such as is described further below.

The plastic molded insert 12 includes a main body 14 which fits against the back of the wearer. The plastic molded insert 12 comes in one or more sizes in order to fit the various frame sizes of possible wearers.

The plastic molded insert 12 contains a weight shelf 16 proximate the bottom. The weight shelf 16 is constructed to hold one or more weights 70.

A curved portion 18 is located proximate the lower portion of the body 14 of the plastic molded insert 12. The curve 18 conforms generally to the natural curvature of small of the back. It will be understood that the radius of the curved portion or curve 18 can vary depending upon the particular support required and the particular size of the plastic molded insert 12 since it is desired to create a comfortable fit with the natural contours of a wearer's back.

Triangular support pieces 20 and 22 are provided for additional support of the weight shelf 16. In a preferred embodiment the triangular support pieces 20 and 22 have one edge attached to the weight shelf 16 and another edge attached to the body 14. These pieces provide additional support for the weights contained on weight shelf 16 which holds and supports the weights 70.

The weight shelf 16 of a preferred embodiment includes two threaded bores or holes 24. These threaded bores receive weight rods 40. The threaded bores 24 are preferably located along an imaginary center line that is defined as being parallel to the outer edge of weight shelf 16. The location of the threaded bores 24 is defined as being approximately at an equal distance from both of the outer edges of weight shelf 16.

As depicted in the drawings, the weight rods 40 are preferably formed from elongated rods and each rod includes a threaded end 44. A flange 46 is located proximate the threaded end 44 of each of the weight rods 40. The preferred embodiment depicted in the drawings, each weight rod 40 is screwed into a respective threaded bore 24 on weight shelf 16.

It will now become apparent that the flange 46 prevents the respective weight rod from being screwed completely through the weight shelf 16 while still allowing the weight rods 40 to be tightly fastened to the weight shelf 16. The weight rods 40 are now positioned and fastened to receive either a single or a plurality of the weights 70.

Peripheral edges of the weight or weights 70 are preferably rounded to provide easy grasping, placement and removal of the weight or weights 70 as the user alters the total weight of the pack. Each weight 70 defines a pair of holes or bores 72. The holes are located so as to correspond to the position of the respective threaded bores 24 located in weight shelf 16 and the position of the respective weight rods 40 threaded into the threaded bores 24. The described arrangement enables each of the weights or weight to slide over the weight rods.

The weights 70 can be provided in five pounds or any other weight deemed suitable for the particular user or wearer of the weight pack. Further, the weights can be used either singularly or in multiples. In this manner the wearer of the weight pack 10 can easily adjust the amount of weight contained therein. The weights 70 could also be made in weights other than five pounds to provide a larger selection.

In operation, in connection with the backpack application previously mentioned to provide additional weight for the walker or hiker, the weight pack 10 is carried on the shoulders of the wearer by the pair of J-hooks 80. The J-hooks preferably include an elongated body portion 82 with a generally inverted J-type hook having a radius 84 preferably determined by the particular size of the weight pack 10. It will be understood that the radius will depend upon the size of the wearer.

These J-hooks 80 are attached to the body 14 of the plastic molded insert 12 by J-hook fingers 50. These J-hook fingers 50 comprise in combination a pin body 52, a threaded end 54 on pin body 52, and a bore end 56 having a bore 58 through the pin body 52. As depicted in the drawing figures, the bore 58 receives a cotter pin 59.

The body 14 of the plastic molded insert 12 preferably includes two or more threaded upper bore portions 28 and two or more threaded lower bore portions 26. The threaded bore portions 26 and 28 each receive its respective J-hook finger 50. In a preferred embodiment the threaded ends 54 of the J-hook fingers 50 are screwed into the threaded bores 26 and 28 and tightened. The bore end 56 of each J-hook finger 50 extends out the back of the plastic molded insert 12 and away from the wearer.

The elongated body 82 of J-hook 80 contains a series of adjustment bores 88. These adjustment bores 88 are placed over and receive the bore end 56 of its respective J-hook finger 50, thereby, providing a means of attaching the J-hooks 80 to the plastic molded insert 12.

The group of adjustment bores 88 are arranged and spaced such that the J-hooks 80 can be vertically adjusted to accommodate various wearer sizes. Once the J-hooks 80 are placed over the J-hook fingers 50, the cotter pin 59 is inserted into the hole 58 in the bored end 56 of J-hook finger 50. The J-hooks 80 should now be securely held in place.

Figure 3:
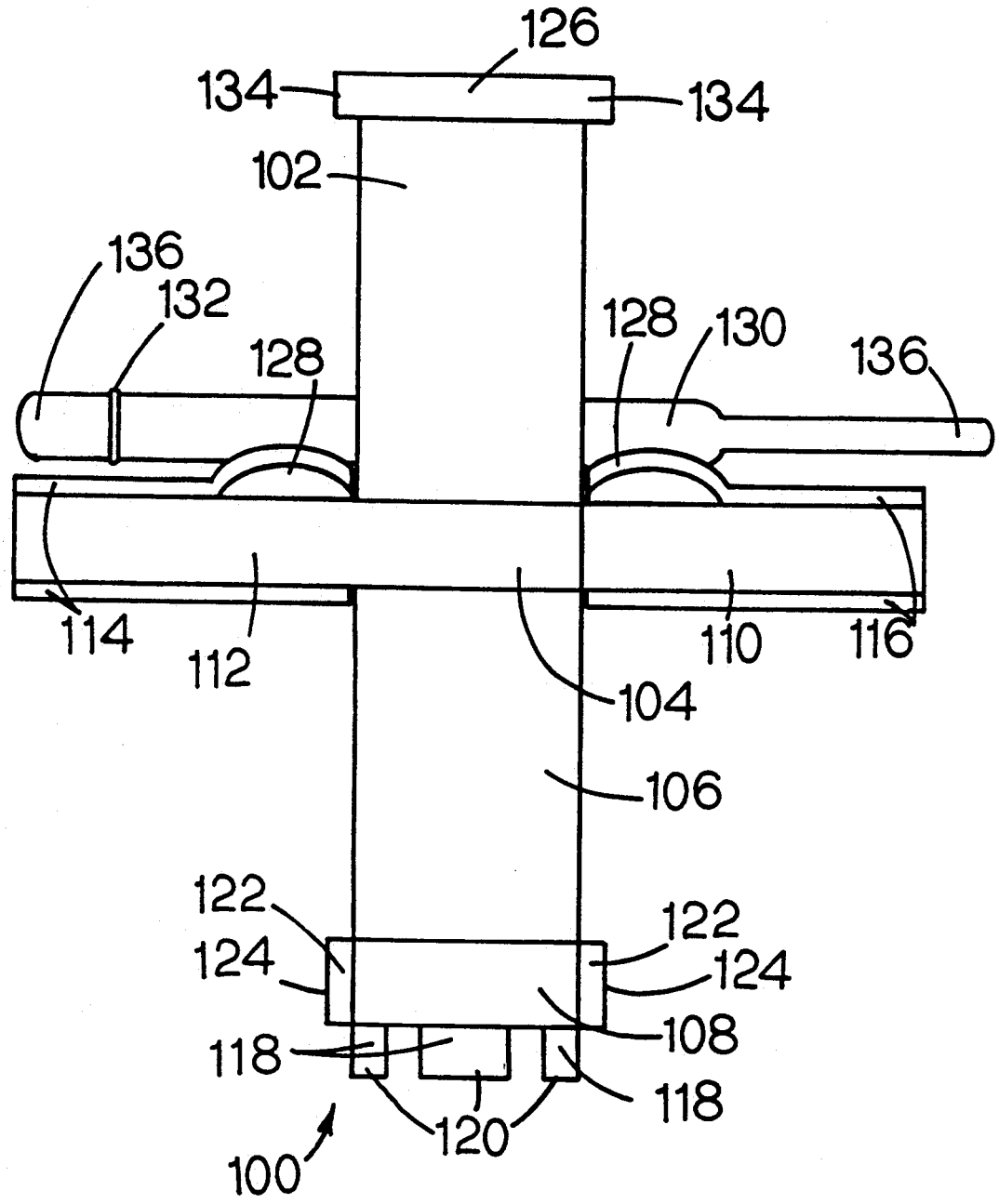
FIG. 3 depicts an outside cover or bag opened up and generally laid flat.

In a preferred embodiment the weight pack 10 is enclosed by a cover or bag 100. The bag 100 is typically constructed from heavy, reinforced, waterproof canvas. However, the bag could be constructed of other suitable material. As illustrated in FIG. 3, the bag 100 includes a back member portion 102, a bottom member portion 104, a front member portion 106, a top member portion 108 and opposing side member portions 110 and 112.

FIG. 3 depicts a developed view of the bag 100 as it would appear when opened up and placed flat. In a preferred embodiment the bag 100 is either cut from a single piece of material or sewn together, for example, at the fold lines, and sized to provide a properly fitted bag.

The opposing side member portions 110 and 112 include sewn on flaps 114 and 116. The one side member portion 110 and the other side member portion 112 fold from the bottom member portion 104 similarly as the back member portion 102 and the front member portion 106. The sewn on flaps 114 and 116 are preferably sewn onto the back member portion 102 and the front member portion 106 so as to form the bag 100 which contains the plastic molded insert 12 and the weights 70.

In a preferred embodiment depicted in the drawing figures the left side member portion 112 and the right side member portion 110 of the bag 100 have a generally rounded extension 128 which is intended to generally conform to the curve portion 18 of the plastic molded insert 12. In this manner the back member portion 102 is sewn onto the side member portions 110 and 112 and there will be provided adequate space and clearance within the bag 100 to accept the curve portion 18 of the plastic molded insert 12.

It will now be understood that the J-hooks 80 extend through openings provided by the construction of the top member portion 108 of the bag 100 and the weight pack 10 can be readily worn by an individual.

Proximate the top of the back member portion 102 there is a sleeve member 126 folded over and down onto the back member portion 102. The sleeve member 126 includes a flap 134 located approximately at each end of the sleeve member 126 and folded around and sewn at the edges. The sewn sleeve member provides a pocket for receiving the top portion 30 of the plastic molded insert 12.

The top member portion 108 folds over such that the tabs 118 attach the top to the back member portion 102. In a preferred embodiment fastening is facilitated by the use of a VELCRO ® brand fastener 120. Thus, there is provided a generally completely enclosed bag for containing the components of the weight pack 10, including the plastic molded insert 12 and a weight or weights 70.

The generally rectangular shape of the bag 100 is maintained through the use and incorporation of support rods 60. The support rods 60 are received into fittings provided in the plastic molded insert 12. Each preferred support rod 60 includes an inverted L-shape rod having a long vertical leg 64 and a short horizontal leg 62. An end of the leg 64 is received by a hole 66 defined by the outer corners of the weight shelf 16. Similarly, the end of the short leg 62 is received by a hole 68 defined by the upper corner of the body 14 of the plastic molded insert 12.

A belt member 130 is provided and may be either attached to the bag 100 or provided as a part of and cut from the same piece of canvas or other material from which the bag 100 is manufactured. The belt member 130 holds the weight pack 10 securely to the wearer. The belt member 130 is intended to generally fit around the midsection or waist of the wearer and the ends of the belt member 130 are secured to each other. In a preferred embodiment the ends are secured by VELCRO ® brand fasteners 136.

The use of a preferred embodiment will now be further described. In operation, the wearer would slide the desired number of weights 70 onto the respective weight rods 40 received by the weight shelf 16 of the plastic molded insert 12. Upon selecting and installing the desired weight, then the top member portion 108 is closed and secured by the VELCRO ® brand fastener portions of the tabs 118 and 124.

The weight pack 10 is now placed over the shoulders of the wearer such that J-hooks 80 rest on the shoulders. The belt 130 is comfortably but tightly and securely fastened around the waist or midsection of the wearer to hold the weight pack 10 in place. In this manner the weight pack 10 is carried on the upper body and at or above the center of gravity of the wearer.

In a preferred embodiment the weight pack 10 includes the plastic molded insert 12 with the body 12 approximately 13 inches in width, ½ inch thick, 20 inches in height, and a weight shelf 16 measuring approximately ½ inch thick, 13 inches wide and 4 ½ inches deep extending at a 90° angle from the bottom of body 14. It is understood that the curved portion is intended to conform to a variety of wearer's and a curvature has been selected that is proximate the bottom of the approximately 20 inch high body member 14.

In one preferred embodiment depicted in the drawing figures, the weight shelf 16 and the body portion 14 are molded as a single unit. The triangular pieces 20 and 22 are approximately ½ inch thick and have legs approximately equal to or less than 4 inches are located on opposing sides for additional strength where the body portion 14 and the weight shelf 16 join at approximately 90°.

In a preferred embodiment the approximately 13 inch by 20 inch body member 14 includes two holes approximately 1 inch diameter and these holes 28 are located at the juncture of imaginary lines located approximately 3 inches on center from the top 30 and the opposing sides.

There are two holes 26 approximately 1 inch diameter that approximately 9 inches on center relative to the top and approximately 3 inches on center relative the sides. Holes 26 and 28 are threaded to receive the four J-hook fingers 50 approximately four 1½ inch long and 1 inch diameter with complementary male threaded ends 54 approximately ½ inch long.

The fingers 50 include holes 58 that are approximately ⅛ inch diameter and located approximately ¼ inch from the non-threaded end 56. It will be understood that the holes 58 accommodate "cotter type" pins 59.

There are also provided two recessed threaded holes 24 approximately 1 inch diameter and approximately 3 inches on center relative the outer opposing side edges of the extending weight shelf 16 and approximately 2 inches from the edge farthest from the approximately 13 inch by 20 inch body 14 to accommodate the two approximately 19 inch by 1 inch diameter weight rods 40 and associated flanges 46 and an approximately ½ inch threaded end 44 provided to facilitate proper weight placement within the weight pack of the present invention.

Two inverted "J" hooks 80 approximately 2 inches wide and 178 inch thick with a hook spread 84 of approximately 6 inches support the weight pack 10 on the shoulders of the wearer. The "J" hooks 80 include five approximately 1 inch diameter adjustment bores or holes 88 that are spaced apart approximately 3 inches. One is approximately 1½ inches from the bottom 90 of each hook 80. The total length of the hooks from the bottom 90 to the top or apex of the approximately 6 inch curve 86 is approximately 19½ inches.

The hook spread or diameter identified as reference character 84 of approximately 6 inches results in a hook that forms a half circle that is approximately 6 inches across and 3 inches high. The five approximately 2 inches apart adjustment bores or holes 88 allow three settings for J-hooks 80. The hooks may extend approximately 3 inches above the top of the bag 100 and the plastic molded insert 12, the hooks may extend approximately 6 inches above the bag, and the hooks may extend approximately 9 inches above the bag.

It will be understood that these dimensions can be varies if it is determined that a larger range of adjustment is desired. The hooks can be manufactured in additional (or less if desired) lengths.

A relatively rigid bag is desired to maintain the rectangular shape, particularly in the backpack embodiment. Therefore, there can be two metal "L" shaped support rods 60 approximately ⅛ inch in circumference with a long vertical leg 64 of approximately 17¾ inches and a short horizontal leg 62 approximately 4½ inches. Metal support rods 60 insert into holes 66 and 68 (four of them, pre-drilled) approximately ¼ inch deep, approximately ⅛ inch diameter holes.

In a preferred embodiment there are two holes located approximately ¼ inch from the edge of the weight shelf 16 located away from the body 14 and approximately ¼ inch from each side of the weight shelf 16. Two holes 68 are preferably located approximately ¼ inch from the sides and approximately 2 inches below the top 30 of the body 14.

In a preferred embodiment the weights 70 are manufactured of lead or another equivalent material with sufficient mass to provide weights in desired increments (e.g., five pounds). The weights 70 are preferably generally rectangular in shape and approximately 11⅞ inches wide by 4 inches deep by ½ inch thick. Rounding the outside edges (of the ½ inch thick edge) promotes easy grasping, placement and removal of the weights.

Each weight in a preferred embodiment includes two approximately 1 inch diameter holes 72 located approximately 2 inches apart front to back and approximately 2 7/16 inches from each side to enable the weights 70 to slide up and down the weight rods 40.

It is reasonable to provide ten five pound weights with the bag to give a total possible maximum weight inside the bag of fifty pounds. It is believed that the bag and insert will weigh approximately ten pounds. Additional weights can be made available, and it is believed that a properly constructed bag would be capable of holding up to approximately one hundred pounds.

It should be apparent that as with any exercise equipment, care should be used in determining whether to use the weight pack and the amount of weight to carry. In case of any question regarding use of the weight pack or the amount of weight to use a physicians advice must be obtained.

In a preferred embodiment the bag 100 is constructed of a heavy, reinforced, waterproof canvas. Where sewn, double stitching will be used to give greater strength. Approximately the top 2 inches of the back member portion 102 includes the sleeve 126 used to form a pocket for receiving the top 30 of the plastic molded insert 12. The sleeve comprises a flap 134 approximately 2½ inches extending approximately 1½ inches beyond each side member portion connected to the top of the back member portion 102.

The sleeve 126 can be sewn to the top by folding the sleeve forward and down and the side flaps 134 back and around while only sewing the side flaps.

The preferred bag 100 resembles the shape of a cross when unfolded. The back member portion 102 is approximately 13 inches wide by 22 inches long. The one side member portion 112 is approximately 7 inches wide by 20 inches long and approximately 1 inch wide at flaps 114. The flaps provide material to construct or sew the bag 100.

For example, to facilitate sewing the flaps 114 can run the full length of both sides, approximately 20 inches on both sides (cutting approximately 1 inch in at the junction with the back member portion).

The bottom member portion 104 is connected to the back member portion 102, the one side member portion 112, the other side member portion 110, and the front member portion 106. The bottom member portion 104 is preferably approximately 13 inches wide by 5 inches deep. The one side member portion 110 mirrors the other side member portion 112.

The flaps 114 and 116 are sewn to the back section by folding the sides and bottom up, then continuing the fold by folding the left and right sides up, folding the flaps around the back of the back and then stitching with a suitable stitch for the material the entire approximately 20 inch length.

The front member portion 106 extends from the bottom of the bag and is approximately 13 inches wide by 20 inches long. The front member portion 106 is sewn to the sides 112 and 114 by first folding the front up and then folding the left and right side front flaps around the front and then stitching with a suitable stitch for the material the entire approximately 20 inch length. The top member portion 108 of the bag is approximately 16 inches wide, to allow for approximately 1½ inch flaps on each side.

As previously described, VELCRO® brand fasteners are located at the sides for closing, and are preferably approximately 5 inches deep and have a VELCRO® brand strip approximately 2 inches wide by 3 inches long on each end and another VELCRO® brand strip approximately 5 inches wide by 3 inches long in the middle that fit snugly along the "J" hooks 80 to provide a construction that is intended to make the bag water resistant.

It will be understood that the location of the "hook" portion and the "loop" portion of the fasteners has not been detailed. It will be further understood that, even though not illustrated, it is within the ability of one skilled in the art to provide any number of equivalent fastener methods and VELCRO® brand fasteners have been shown as one preferred embodiment.

Endeavoring to provide a comfortable fit the side of the bag against the body has attached to it any waterproof cushioning material. This same waterproof cushioning material can be used for the shoulder "J" hooks as previously described.

In a preferred embodiment a double thickness canvas belt 130 approximately 3 inches wide and 57 inches long is sewn to the bag outside back portion (the side adjacent the body or clothing of the wearer) and at approximately the apex of the small of the back curve. This location tends to stabilize and secure the bag and lend additional support to the wearer's stomach muscles (which can also be seen in belts worn by weight lifters). The belt includes adequate cushioning material for comfort. The belt wraps around the wearer's midsection or waist.

In a preferred embodiment the belt is secured by extending the right end 136 through a loop 132 on the left side approximately 6 inches from the end of the left side. The extending right end pulls back through the loop and secures in place by a suitable fastener assembly, for example a VELCRO® brand combination.

Figure 4:
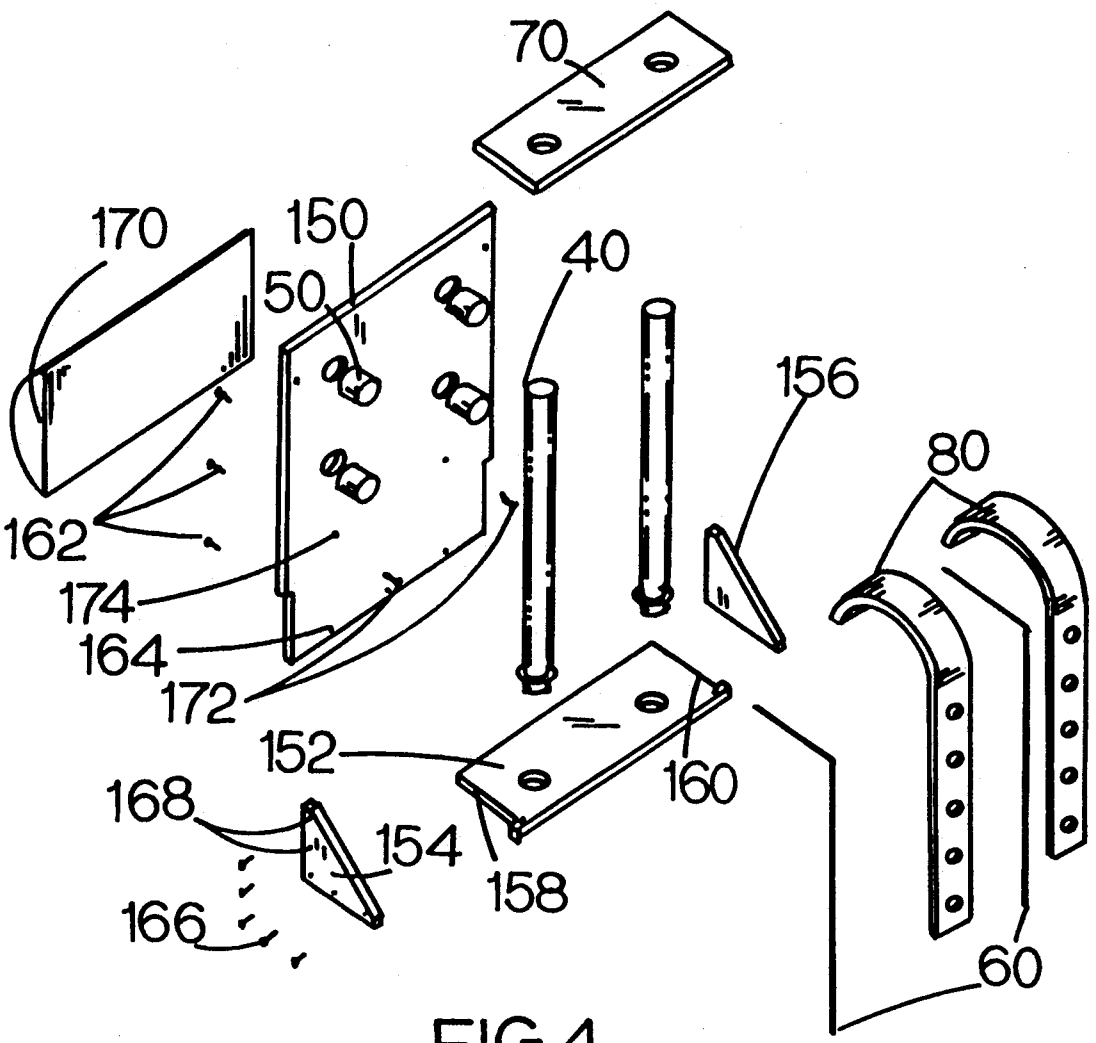
FIG. 4 is an exploded view of another embodiment of the weight pack.
Figure 4A:
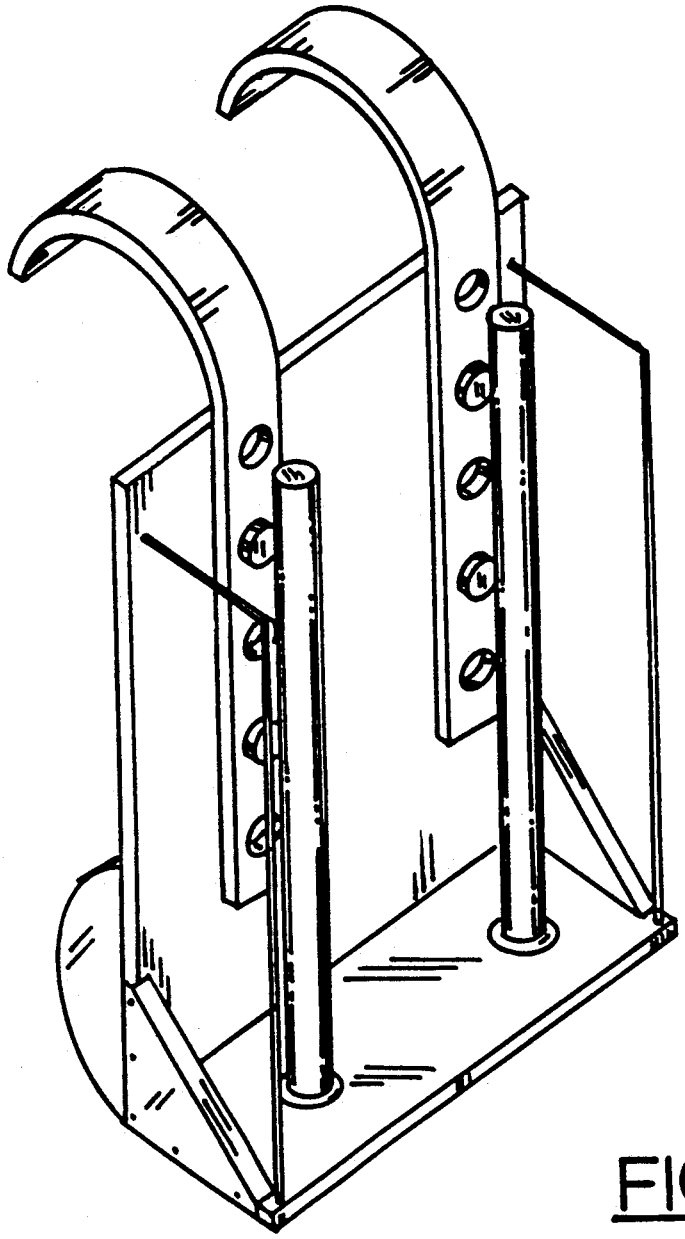
FIG. 4A is perspective view of the embodiment illustrated in FIG. 4

While the preferred embodiment illustrated and described above is suitable, there are practical problems associated with a molded construction that related to economy of construction and manufacture and ease of packaging and storage that are solved by the preferred embodiment illustrated in FIG. 4 and FIG. 4A.

More particularly, the molded member has been rendered in a "knock-down" embodiment which differs from the previously described embodiment in the following manner.

A back member 150 is manufactured from a single piece approximately 13 inches by 20 inches. A weight shelf member 152 is approximately 13 inches by 4½ inches.

A pair of triangles 154 and 156 are both approximately 4½ inches by 4½ inches manufactured from a pair of approximately 5 inch by 5 inch triangles from which approximately ½ inches is removed from each of the sides opposite the 90° angle.

It is presumed that each of the foregoing members are manufactured from a solid flat sheet of approximately ½ inch stock "tough stuff" plastic or its equivalent.

The pieces fit together by means of the approximately ½ inch by 4½ inch cutouts 158 and 160 located and defined by each side of the weight shelf 152 proximate the end that forming a 90° angle with the back 150 and the adjacent end proximate the bottom flush with respect to the other.

The weight shelf 152 attaches flush to the bottom edge of the back 150 by a plastic glue and three fasteners. In the preferred embodiment these fasteners are flathead screws 162 located approximately equidistant and approximately 1½ inches by ⅛ inch in diameter. The screws are received through three pre-drilled holes 164 in the back and into starter holes defined by the edge of the weight shelf.

It is preferred to strengthen the joined back 150 and the weight shelf 152 by slotting the two short leg triangles 154 and 156 approximately 4½ inches by 4½ inches and locating them in the back cutout 150 and the shelf cutout 158 located on each side.

The triangles are preferably permanently attached by the plastic glue and associated fasteners. In the preferred embodiment illustrated there are shown five flathead screws 166 approximately 1½ inches by ⅛ inch and located at each of the triangles 154 and 156. The screws attach the triangles 154 and 156 to the back 150 and the weight shelf 152.

Attachment is facilitated by five pre-drilled holes 168 located the two ends of each leg of the triangles and at approximately 90° at the juncture of these two ends located approximately midway along the legs. Five complementary starter holes are provided.

The curved portion is provided by using a partial cylinder 170 that is approximately 13 inches wide by 8 inches across by 2 inches deep to conform to the curvature of the wearers back as previously described. The partial cylinder 170 is attached flush proximate the bottom of the back member 150 on the side adjacent the wearer with a suitable amount of a plastic glue and two fasteners.

In a preferred embodiment the fasteners are flathead screws 172 approximately 1½ inches by ⅛ inch extending through two generally equidistant pre-drilled holes 174 from the inside of the back/weight shelf insert and into starter holes located along an imaginary line that corresponds to the approximately 2 inch maximum depth of the formed piece being attached.

The four holes 26 and 28 defined by the back member 150 are approximately 1 inch diameter. The holes 24 in the weight shelf 152 are approximately 1 inch. The four "L" rod holes 66 and 68 are approximately ¼ inch by ⅛ inch diameter. It will be understood that these openings that facilitate construction a the preferred embodiment of the present invention have specifications similar to those previously described for another preferred embodiment.

The two weight rods 40, the four "J" hook fingers 50, the two "L" rods 60, the weights 70, and the two "J" hooks 80 are constructed as generally described previously for another preferred embodiment.

From the foregoing description those skilled in the art will appreciated that all of the objects of the present invention are realized. A weight pack has been shown and described for providing a weight carrying construction that can be used in exercise and that is usable by practically anyone who qualifies physically. The construction and use of the weight pack and the backpack embodiment exerts relatively low stress on the back, knees and feet and is easily adaptable for use during routine activities.

The weight pack and backpack embodiment is substantially rigid and will not easily or readily deform or become unbalanced, for example, by allowing a weight shift while wearing the weight pack and performing other activities. The weight pack can accommodate a varying amounts of weights with the user provided with a range of weights to select from and either add or remove weights as desired.

The weight pack gives the outward appearance of a conventional backpack and carries the selected weights mounted for ease of selection and change by the wearer. The weight pack has many of the functional characteristics of a conventional backpack. The weight pack of the present invention provides shoulder supports and a mid-section belt or support.

These and other features of the present invention provide ease and convenience for the wearer and only a minimum of preparation. In fact, with the weights and weight supporting structure removed, it will now be apparent that the weight pack will also function as a backpack, if so desired.

Two preferred embodiments of the weight pack now have been described. One is constructed from a single molded piece and the other is constructed from a plurality of components. The present invention provides an economically produced backpack for exercising which can be used as a conventional backpack when not used with the weights.

While specific embodiments have been shown and described, many variations are possible. As has already been discussed, the particular shape and combination of components can vary and still provide the weight pack of the present invention. The dimensions and materials may be changed as desired to suit the environment and the wearer. The materials may change although the plastics and fasteners referred to are preferred. The configuration and number of weights may vary although the preferred embodiment shows a maximum of 10 five pound weights. also, in the embodiment described there have been described various plastic components. In another embodiment a metal construction is possible for the insert 12, the fingers 50, and the weight rods 60. The metal construction procedure and details would be similar to those in the embodiments disclosed above. It will be understood that there will be dissimilarities relative to metal working versus plastic working.

Thickness of the insert body 14, the weight shelf 16, and the J-hooks 80 would be reduced to allow for the strength and weight of the metal. The other dimensions would be adjusted accordingly.

All of the fingers, rods, and support rods would require flanges or equivalent structure in order to force them flush with receiving securing means, for example, lock caps or nuts and lock washers on the opposite side of where the finger, rod or support rod extends through the insert. It will be recognized that for nuts, this will require that the fingers, rod and support rods have threads on their connecting sides. Also, a metal construction may require an adjustment of the amount of weight carried due to an increased weight of the pack.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A weight support for supporting and carrying one or more weights during exercise, the enclosure comprising:

support means for supporting a weight, the support means including a contour portion located proximate a lower portion of the weight support so as to be proximate and generally complementary to the natural lumbar curve of the back of the wearer as the weight support is worn in its intended fashion;

attachment means for attaching and supporting the enclosure with respect to the body size of a wearer, the attachment means supporting the enclosure generally on the upper body of the wearer and at or above the center of gravity of the wearer;

the weight received by the support means;

enclosure means for receiving and enclosing the support means and the weight, the enclosure means integrated with the attachment means;

a generally rigid insert forming the support means, wherein the generally rigid insert includes a body portion and a weight shelf portion generally projecting from the body portion; and weight securing rods received by the weight shelf, the weight securing rods stabilizing the weight on the weight shelf.

2. A weight support as set forth in claim 1 wherein the support means comprises a rigid insert constituting the main support for said weight pack, said insert having a body section which corresponds to the size of the wearer and a weight shelf extending from said body section.

3. A weight support as set forth in claim 2 wherein more than one weight is received by the weight shelf and the support means.

4. A weight support as set forth in claim 3 wherein each weight has a shape generally complementary to the shape of the weight shelf.

5. A weight support as set forth in claim 1 wherein the enclosure means comprises a bag for receiving the support means and the weights.

6. A weight support as set forth in claim 5 wherein the attachment means extends from the bag.

7. A weight support as set forth in claim 6 wherein the bag includes a belt for securing the weight support to the waist or midsection of the wearer.

8. A weight support as set forth in claim 1 further comprising a plurality of inverted J-hooks attached to the generally rigid insert adjacent the back of the wearer, the J-hooks generally supporting the weight support on the shoulders of the wearer.

9. A weight support as set forth in claim 8 wherein the J-hooks include adjustment means for adjusting the J-hooks on the generally rigid insert.

10. A weight support as set forth in claim 8 wherein a plurality of J-hooks extending from a top of a bag.

11. A weight pack, comprising:

a rigid insert constituting the main support for the weight pack, the insert having a body section which corresponds to the size of the wearer and a weight shelf extending from one side of the body section and a contour portion, which complements the natural contour portion (or lumbar curve) of the back, located proximate and in opposition to the weight shelf as the weight support is worn in its intended fashion;

at least one weight for placement on the weight shelf on the insert, each weight having the same general shape as the weight shelf;

an attachment means attached to a back side of the body section of the insert, the attachment means for placement of the weight pack on the shoulders of the wearer; and a bag for receiving the insert and at least one weight, the attachment means extending from the bag, the bag having an attached belt for securing the weight pack to the waist or midsection of the wearer.

12. A weight pack, comprising:

a rigid insert constituting the main support for the weight pack, the insert having a body section which corresponds to the size of the wearer and a weight shelf extending from the body section;

weights for placement on the weight shelf on the insert, the weights having the same general shape as the weight shelf;

weight rods securely attached to the weight shelf to securely hold the weights on the weight shelf;

inverted J-hooks attached to a back side of the body section of the insert, the J-hooks for placement of the weight pack on the shoulders of the wearer;

an adjustment means on the j-hooks and the body section for adjusting the position of the J-hooks on the body section to accommodate the size of the wearer; and a bag for receiving the insert and the weights, the J-hooks extending from a top of the bag, the bag having an attached belt for securing the weight pack to the waist or midsection of the wearer.

13. A weight pack comprising:

a rigid insert providing a main support for the weight pack, the insert including a body section and a weight shelf projecting from the body section, triangular pieces attached to edges of the weight shelf and to the body section for support of the weight shelf and the body having a curvature near the bottom which corresponds to the back of the wearer;

weights for placement on the weight shelf on the insert, the weights having the same general shape as the weight shelf, the weights having bores to receive a weight rod, the weights having rounded edges for ease of grasping, placement and removal of the weights from the weight rod;

weight rods securely attached to the weight shelf to securely hold the weights on the weight shelf, the weight rod sliding though the bores on the weights;

inverted J-hooks attached to a back side of the body section of the insert, the J-hooks for placement of the weight pack on the shoulders of the wearer, the J-hooks having a series of adjustment bores for positioning the J-hooks on the insert for positioning the weight pack on the wearer;

J-hook fingers for attaching the J-hooks to the insert, the J-hook fingers having an end secured to a bore in the body section of the insert, and an end for insertion into the adjustment bores on the J-hook to provide an adjustment means, and a cotter pin for insertion into a hole bored through the end for insertion into the adjustment bores to secure the J-hook finger to the J-hooks;

a bag for receiving the insert and the weights, the J-hooks extending from a top of the bag, the bag having an attached belt for securing the weight pack to the waist or midsection of the wearer; and support rods attached to the insert to support the bag.

14. The weight pack as set forth in claim 13 in which the insert further contains a curvature on the body section, the curvature corresponding to the small of the back of the wearer.

15. The weight pack as set forth in claim 13 in which the attachment means comprises an inverted J-hook, the J-hooks attached to the insert for placement of the weight pack on the back of the wearer, and an adjustment means for adjusting the position of the weight pack on the back of the wearer.

16. The weight pack as set forth in claim 15 in which the adjustment means comprises a series of adjustment bores on the J-hooks and J-hook fingers for attaching the J-hooks to the insert, the J-hook fingers being attached to the insert, the J-hooks being adjustable and attached to the insert by the J-hook fingers extending through the adjustment bores on the J-hooks.

* * * * *